US011304501B1

(12) United States Patent
Doan

(10) Patent No.: US 11,304,501 B1
(45) Date of Patent: Apr. 19, 2022

(54) CONFIGURABLE STRAP

(71) Applicant: Dzuy Doan, Garden Grove, CA (US)

(72) Inventor: Dzuy Doan, Garden Grove, CA (US)

( * ) Notice: Subject to any disclaimer, the term of this patent is extended or adjusted under 35 U.S.C. 154(b) by 0 days.

(21) Appl. No.: 17/491,580

(22) Filed: Oct. 1, 2021

(51) Int. Cl.

| | |
|---|---|
| ***A45F 3/14*** | (2006.01) |
| ***A45F 3/02*** | (2006.01) |
| ***A44B 19/30*** | (2006.01) |
| ***A44B 19/34*** | (2006.01) |
| ***A45F 3/00*** | (2006.01) |

(52) U.S. Cl.
CPC ..... *A45F 3/14* (2013.01); *A44B 19/30* (2013.01); *A44B 19/34* (2013.01); *A45F 3/02* (2013.01); *A45F 2003/002* (2013.01); *A45F 2003/142* (2013.01)

(58) Field of Classification Search
CPC ..... A45F 3/14; A45F 3/02; A45F 2003/002; A44B 19/30; A44B 19/34; Y10T 24/2502; Y10T 24/2586; A45C 13/30; A45C 2013/303
USPC ..... 224/257, 578, 579, 258, 260, 632; 24/386, 415
See application file for complete search history.

(56) References Cited

U.S. PATENT DOCUMENTS 830,606 A * 9/1906 Lovett ..... E06C 7/187 182/8
2,563,766 A * 8/1951 Weinstein ..... A47D 15/006 119/857
3,530,919 A 9/1970 May
4,159,792 A * 7/1979 Siegal ..... A41D 19/0041 224/267
4,710,983 A * 12/1987 Markoff ..... A41D 15/04 2/301
5,370,286 A * 12/1994 Newman ..... A45F 3/14 119/857
5,437,401 A * 8/1995 Seltzer ..... A45F 3/02 224/153
5,603,545 A * 2/1997 Benson ..... A45F 3/14 224/250
D402,191 S * 12/1998 Feder ..... D8/395
6,138,881 A * 10/2000 Paul ..... A45F 3/02 224/153
6,647,555 B2 * 11/2003 Yamaguchi ..... A45C 7/0059 2/301
6,662,753 B1 * 12/2003 Sporn ..... A01K 27/003 119/797
6,926,183 B2 8/2005 Chang
(Continued)

FOREIGN PATENT DOCUMENTS

DE 102006015500 A1 * 1/2007 ..... A45F 3/14
WO 2010097208 A1 9/2010
WO WO-2010097208 A1 * 9/2010 ..... A45F 3/14

*Primary Examiner* — Nathan J Newhouse
*Assistant Examiner* — Lester L Vanterpool

(57) ABSTRACT

Disclosed herein is a novel configurable strap apparatus that may comprise end clasps attachable to zipper sliders disposed on a zipper edge of the strap. An end clasp may attach to a zipper slider creating a strap loop that facilitates wearing the strap around the neck, or over the shoulder. An accessory, such as a carrying pouch, may be attached to and thereby suspended from an end clasp. Alternatively, an end clasp may attach to a zipper slider creating a strap loop that facilitates capturing and thereby suspending an accessory such as a beverage bottle.

20 Claims, 8 Drawing Sheets

(56) References Cited

U.S. PATENT DOCUMENTS

| | | | | |
|---|---|---|---|---|
| 7,509,985 | B2 * | 3/2009 | Metsch | A45C 13/103 150/127 |
| 8,689,841 | B2 * | 4/2014 | Bortz | A45C 13/103 150/127 |
| 10,245,486 | B2 | 4/2019 | Burgess et al. | |
| 10,816,305 | B1 * | 10/2020 | Beavers | F41C 33/007 |
| 11,097,800 | B1 * | 8/2021 | Trentacosta | A45F 3/04 |
| 2002/0142123 | A1 * | 10/2002 | Yamaguchi | A45C 13/26 428/58 |
| 2008/0203123 | A1 * | 8/2008 | de Leon | A45C 13/103 224/217 |
| 2011/0068021 | A1 * | 3/2011 | Tuchman | B60D 1/18 206/216 |
| 2011/0186606 | A1 * | 8/2011 | Apthorp | G10G 5/005 224/257 |
| 2012/0111904 | A1 * | 5/2012 | Kim | A45F 3/14 224/158 |
| 2012/0320053 | A1 * | 12/2012 | Miyatani | G06T 7/75 345/420 |
| 2014/0161370 | A1 * | 6/2014 | Tuchman | A45C 9/00 383/4 |
| 2015/0033510 | A1 * | 2/2015 | Nagi | A45F 3/14 24/302 |
| 2018/0310696 | A1 | 11/2018 | Getter | |

* cited by examiner

CONFIGURABLE STRAP

FIELD

The present invention relates to configurable straps. More particularly, the present invention relates to configurable straps comprising end clasps attachable to zipper sliders to create a plurality of wearing and accessory attachment configurations.

BACKGROUND

There has been an unmet need for a strap that has versatility and visual appeal. In particular, there has been a need for a strap that can be configured to be worn in a variety of arrangements on the body while supporting fashion accessories or utilitarian items. Additionally, a strap is desired that, when reconfigured, maintains its configuration stably and reliably. Furthermore, a strap is desired that can serve as an element of a fashion assembly that is visually appealing and designed to be particularly comfortable to wear on one's person. Also, such a strap would benefit from being constructed, in certain embodiments, from components traditionally available in the fashion accessory and apparel fields, such as clasps, zippers, and zipper sliders.

SUMMARY

In exemplary embodiments of the present invention, a configurable strap is provided comprising an elongated strap with a zipper along at least one edge. In certain embodiments, the strap also includes clasps, such as "lobster" clasps, at each end of the strap. Furthermore, in certain embodiments, that strap includes one or more zipper sliders disposed on the zipper.

The lobster clasp at one end may clasp to the zipper slider, thereby forming a loop of a selected size, depending upon where the zipper slider is along the zipper length. In certain embodiments, the zipper slider is lockable so that the loop size remains firmly and reliable fixed. The loop can facilitate wearing the strap on one's person, for example, by positioning the loop around one's neck, across one's torso, or around one's shoulder.

In certain configurations, a fashion accessory or utilitarian article can be secured to the clasp at the other end of the strap, thereby being suspended for carrying. Alternatively, the clasp at the other end can be clasped to a second zipper slider disposed along the zipper's length, forming a second loop. That loop can surround and capture tightly an accessory or utilitarian item, such as a beverage bottle, for example, thereby suspending the item for carrying.

In certain configurations, one side of the zipper teeth may be covered by a teeth liner layer interposed between the zipper and the wearer's body. The teeth liner layer enhances visual appearance and comfort when worn.

Also, in certain configurations, the strap may include a second zipper disposed on the strap edge opposite the first zipper. That zipper may include one or more zipper sliders. The slider or sliders may be lockable. The additional zipper and sliders afford additional strap configurations as described in more detail below.

Additionally, a configurable strap, as thus far described, may be coupled to a second similar strap by being zippered together along their respective zipper edges. The double strap can enhance visual appeal, strength, and configuration versatility.

BRIEF DESCRIPTION OF DRAWINGS

These and other features, aspects, and advantages of the present invention will become better understood with regard to the following descriptions and accompanying drawings. It is to be noted, however, that the drawings illustrate only several embodiments of the invention and are therefore not to be considered limiting of the invention's scope as it can admit to other equally effective embodiments.

DETAILED DESCRIPTION

So that the manner in which the features and advantages of embodiments of methods and systems of the present invention may be understood in more detail, a more particular description of the present invention briefly summarized above may be had by reference to certain embodiments thereof that are illustrated in the appended drawings, which form a part of this specification. The drawings illustrate only certain embodiments of the present invention and are, therefore, not to be considered limiting of the scope of the present invention which includes other useful and effective embodiments as well.

Figure 1:
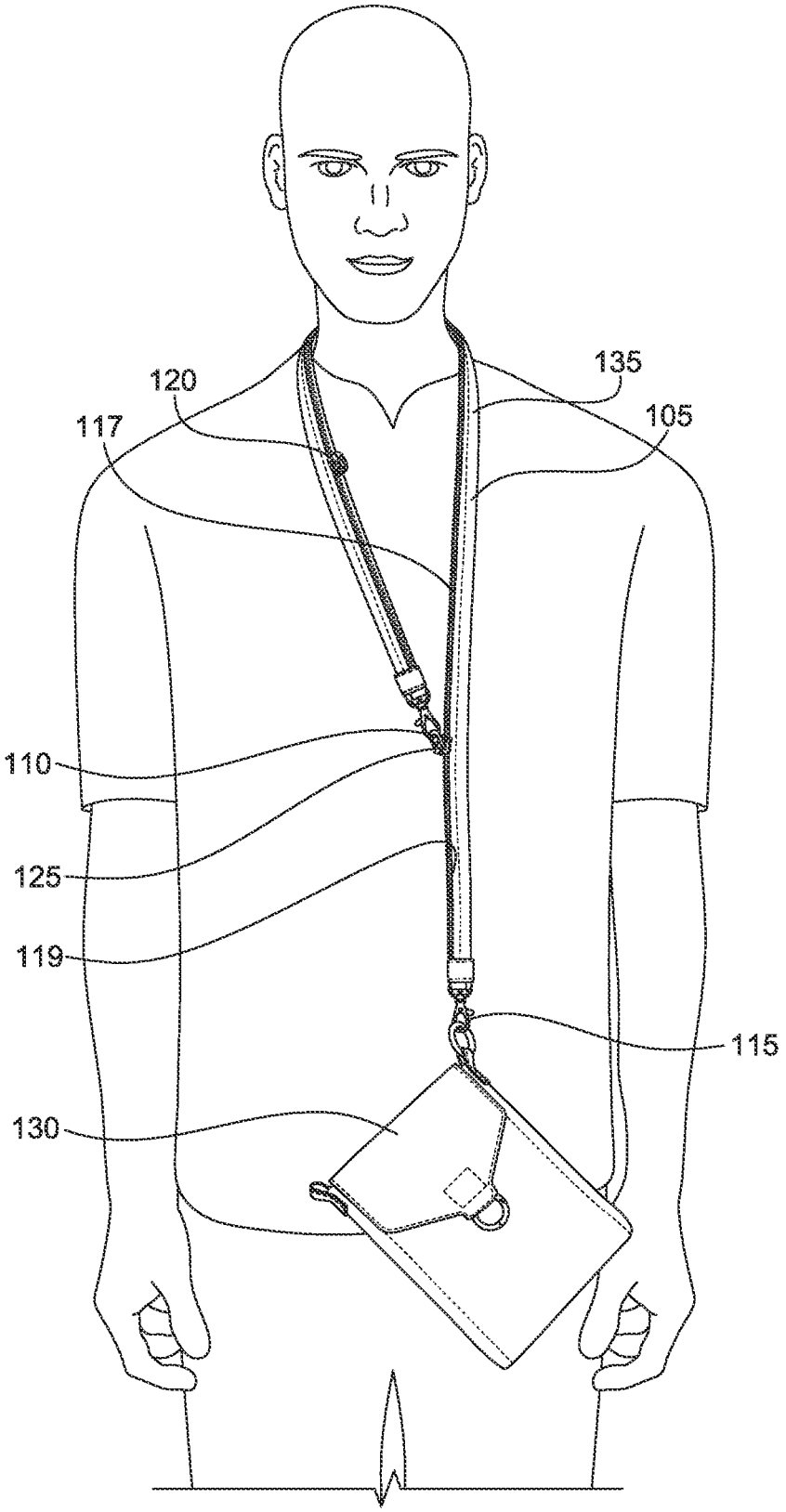
FIG. 1 illustrates a strap according to one embodiment of the present invention configured with a strap loop at one end and an accessory attached at the other end.

Turning to the Figures, FIG. 1 illustrates a strap according to one embodiment of the present invention configured with a strap loop at one end and an accessory attached at the other end. More specifically, FIG. 1 illustrates elongated strap 105. Strap 105 may be made from a variety of materials that may be appealing in the fashion context, such as for example leather or denim. Alternatively, strap 105 may be made from an especially durable material, such as for example, woven nylon, when utilitarian strength is desirable.

FIG. 1 further illustrates end clasps 110 and 115. In the illustrated embodiment, clasps 110 and 115 are attached at respective ends of strap 105. Clasps 110 and 115 may comprise a variety of clasp or fastener types. FIG. 1 illustrates "lobster" clasps. Alternatively, clasps 110 and 115 may be squeeze clasps, screw clasps, simple hooks, or carabiners, as examples.

FIG. 1 further illustrates zipper 117. Zipper 117 is attached to strap edge 119. zipper sliders 120 and 125 are disposed on zipper 117. Zipper sliders 120 and 125 may comprise locking zipper sliders that can be engaged and disengaged from a locked state. Such locking sliders are well known by those of ordinary skill in the pertinent fields. When in locked state, locking sliders 120 and 125 cannot move in at least one direction along zipper 117. FIG. 1 further illustrates accessory 130. Accessory 130 may be a fashion pouch, as an example.

In the embodiment illustrated on FIG. 1, the inventive strap is configured with a strap loop 135 formed at one end, and a fashion accessory suspended at the other end. The strap loop facilitates the strap being worn around the neck, as shown, or alternatively around the torso or shoulder, as other examples.

More specifically, strap loop 135 is formed by clasp 110 clasping to zipper slider 125. The size of the loop can be selected very specifically as defined by the position of zipper slider 125 along zipper 117. In certain embodiments, zipper slider 125 may be placed into a locked state, preventing the slider from moving in a direction that would increase or decrease the size of loop 135. So configured, loop 135 remains stably and securely fixed in size.

In the configuration of FIG. 1, accessory 130 is attached to strap 105 at the other end by being clasped to clasp 115. In the illustrated embodiment, accessory 130 is a carry pouch. Alternatively, any sort of accessory or utilitarian article may be suspended from clasp 115. Consequently, FIG. 1 illustrates a particularly useful configuration and embodiment of the present invention whereby a strap loop can be sized exactly as desired and locked in place. And any article can be suspended from the other end of the strap for carrying.

Figure 2:
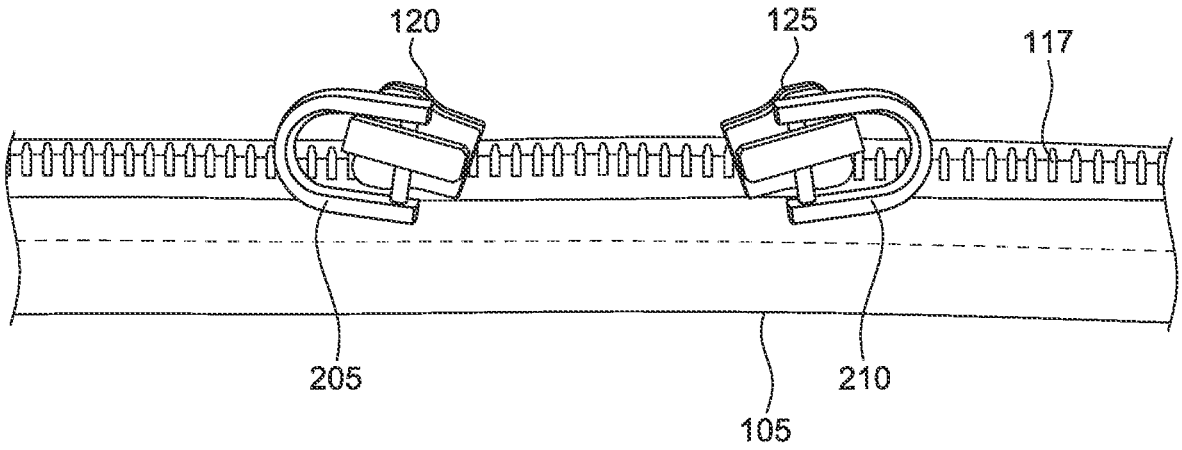
FIG. 2 illustrates zipper sliders comprising elements of one embodiment of the present invention.

FIG. 2 illustrates a more detailed view of zipper sliders 120 and 125 disposed on zipper 117. As shown in FIG. 2, zipper sliders 120 and 125 may further comprise respective slider pulls 205 and 210. In certain configurations of the present invention clasps or accessories may be attached to a zipper slider body itself, slider 120 for example, or alternatively to the slider's pull, pull 205 for example.

Figure 3:
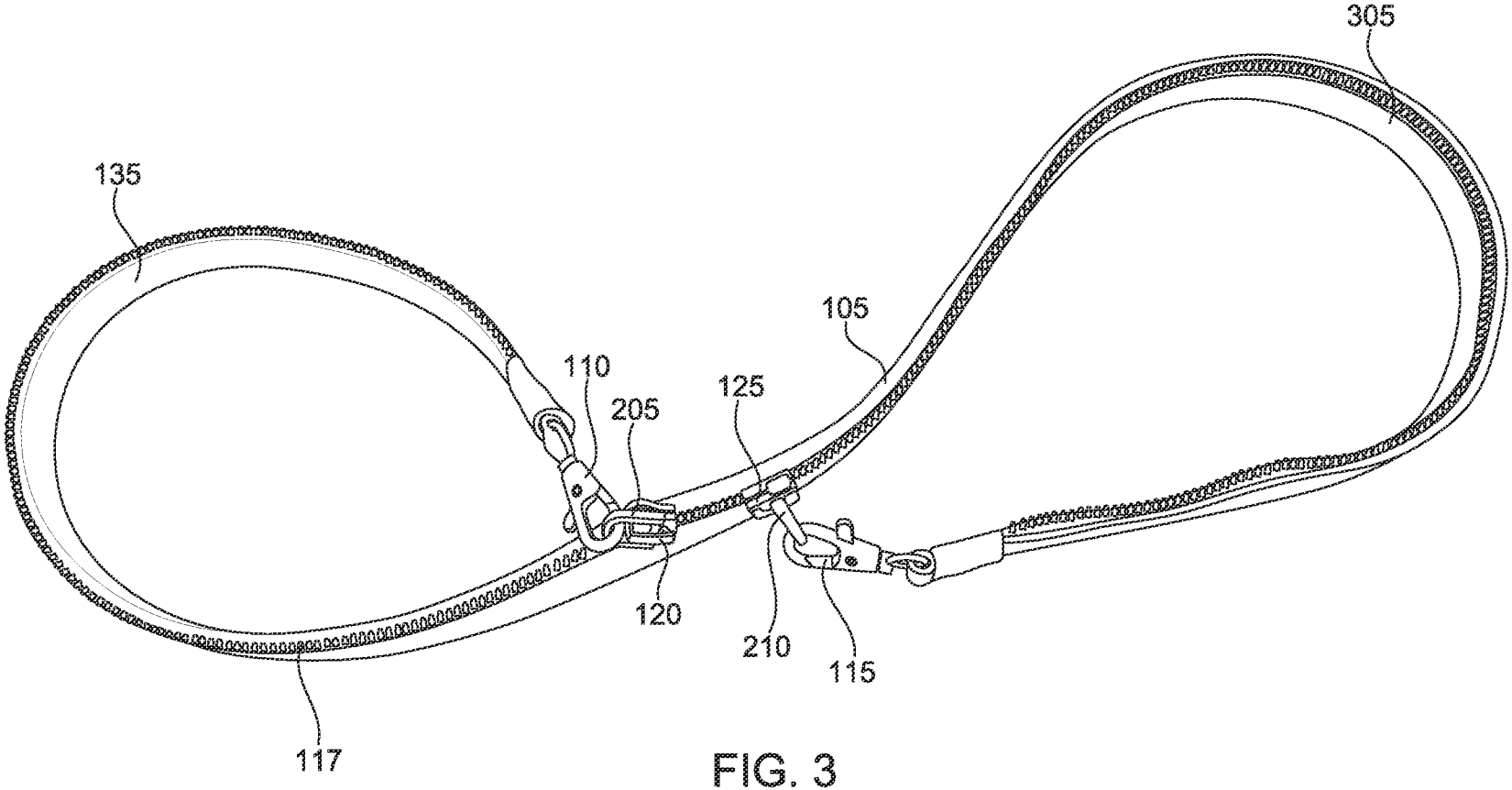
FIG. 3 illustrates a strap configuration according to one embodiment of the present invention, including a strap loop at each end formed by clasps attached to respective zipper slider pulls.

FIG. 3 illustrates a strap configuration according to one embodiment of the present invention including a strap loop at each end formed by clasps attached to respective zipper slider pulls. More specifically, loop 135 is formed by clasp 110 clasping to slider pull 205. Slider 120 may in certain embodiments be of the locking variety. In which case, loop 135 can be sized specifically as desired, and will remain reliably fixed while slider 120 remains in a locked state. Similarly, loop 305 is formed by clasp 115 clasping to slider pull 210. Slider 125 may in certain embodiments be of the locking variety. In which case, loop 305 can be sized specifically as desired, and will remain reliably fixed while slider 125 remains in a locked state.

Figure 4:
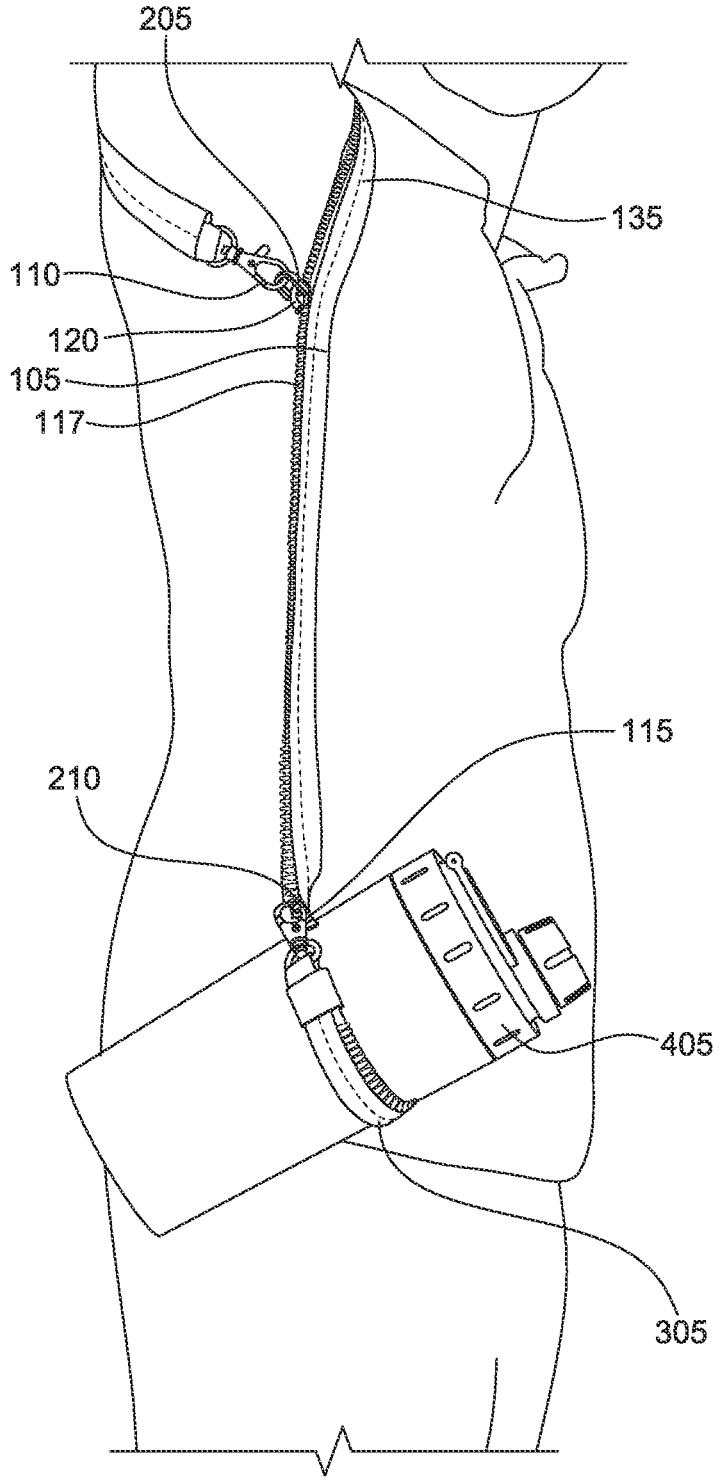
FIG. 4 illustrates a strap configuration according to one embodiment of the present invention, including a strap loop securing and suspending an article for carrying.

FIG. 4 illustrates a strap configuration according to one embodiment of the present invention including a strap loop securing and suspending an article for carrying. More specifically, FIG. 4 illustrates one way that the double loop configuration of FIG. 3 may be employed for a particularly useful application. As shown in FIG. 4, loop 305 surrounds, captures and secures article 405. In the illustrated application, article 405 is a beverage bottle. Alternatively, article 405 may be any suitable fashion accessory or utilitarian article.

In this application loop 135 is looped around the wearer's shoulder for convenient carrying. For this application, zipper sliders 120 and 125 are preferably of the locking variety. When locked, loops 135 and 305 will remain reliably fixed in place and snug.

Figure 5:
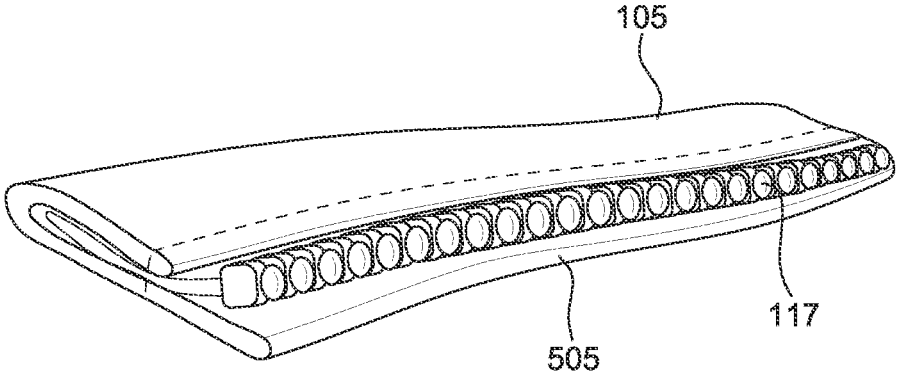
FIG. 5 illustrates a teeth liner element of one embodiment of the present invention.

FIG. 5 illustrates a zipper teeth liner layer 505 according to one embodiment of the present invention. Specifically, teeth liner layer 505 is interposed between the teeth of zipper 117 and the wearer's body. The teeth liner layer enhances the visual appearance and comfort of strap 105 when worn. Liner layer 505 may be made of a variety of materials including the material comprising the rest of strap 105, or a different material. Layer 505 extends to cover the side of zipper 117 that will face a wearer when strap 105 is worn. Preferably layer 505 extends outwardly as far as or past the edge of the teeth of zipper 117. Layer 505 thereby provides cushioning and prevents potential discomfort or abrasions by preventing zipper teeth from rubbing directly against clothing or skin.

Figure 6:
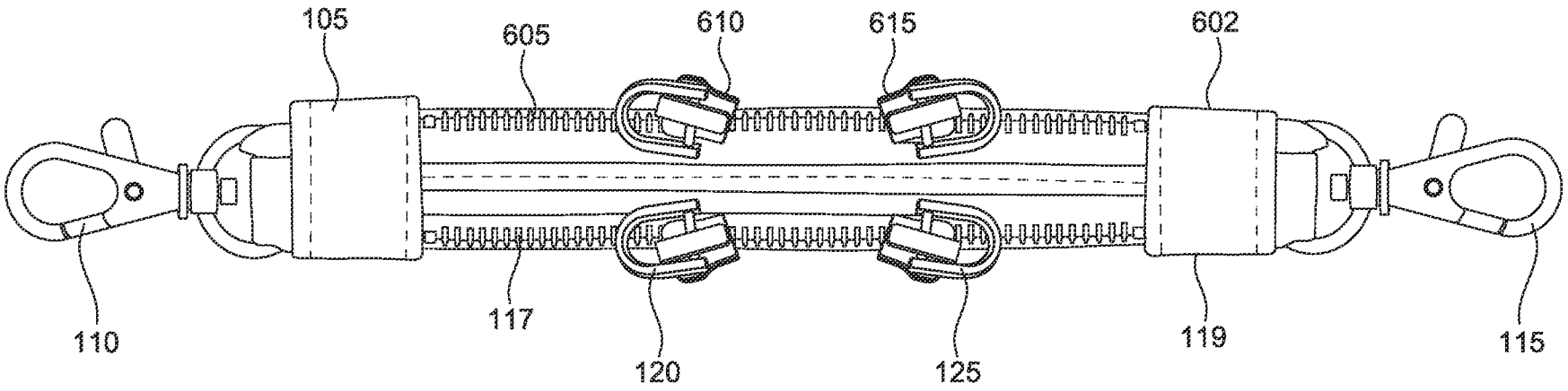
FIG. 6 illustrates a double zipper version of a strap according to one embodiment of the present invention.

FIG. 6 illustrates one embodiment of the present invention incorporating a second zipper 605. Zipper 605 is disposed parallel to, and on a second edge 602 opposite to zipper 117. In the illustrated embodiment, additional zipper sliders 610 and 615 are disposed on zipper 605. Additional zipper 605 together with sliders 610 and 615 facilitate a variety of additional strap configurations. These include, as examples, configurations that suspend additional accessories from sliders, as described in more detail with reference to FIG. 7, and configurations that involved coupling to an additional strap, as described in more detail with reference to FIG. 8.

Figure 7:
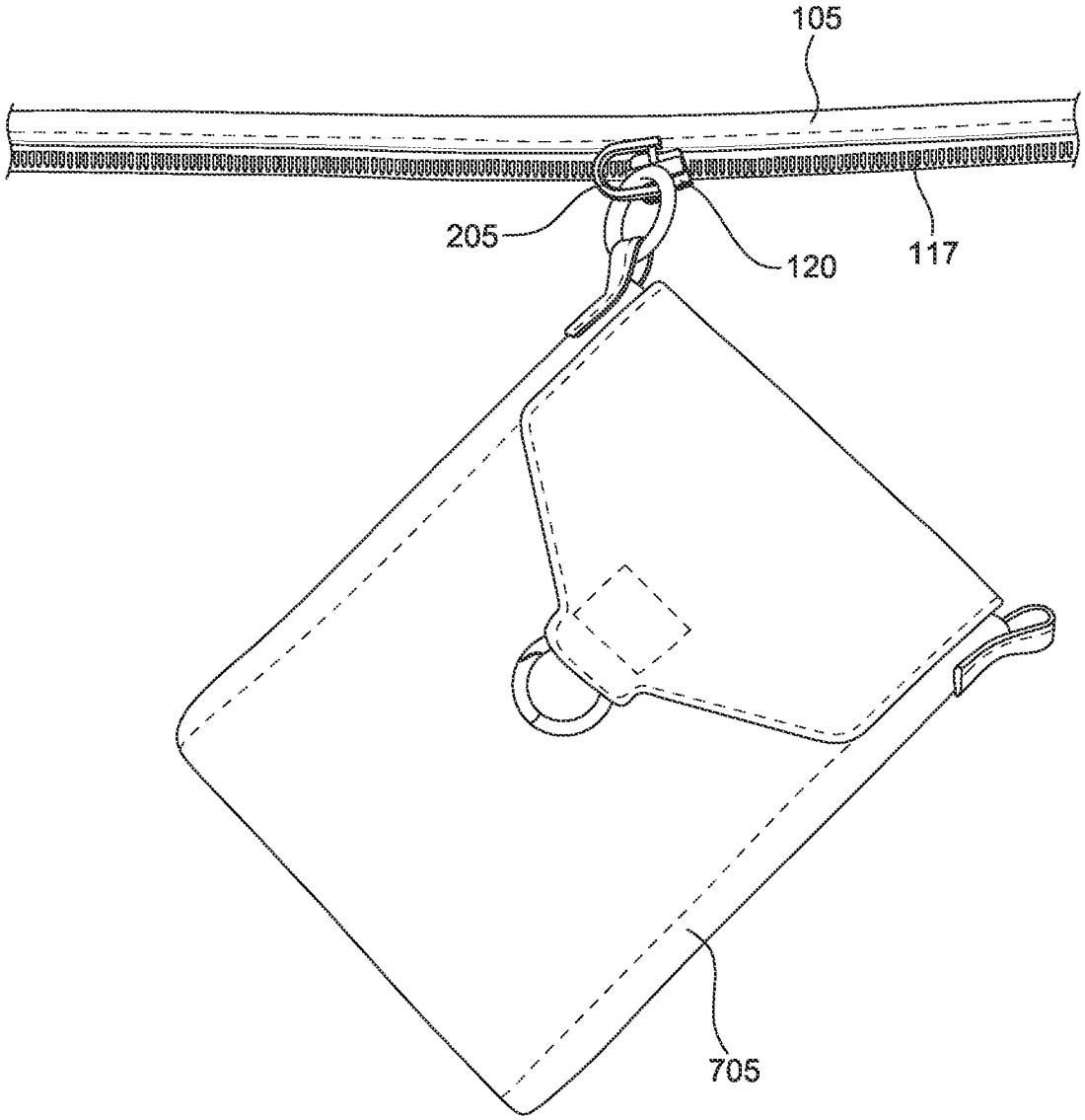
FIG. 7 illustrates an accessory attached to a zipper slider according to one embodiment of the present invention.

Turning to FIG. 7, FIG. 7 illustrates an additional configuration according to one embodiment of the present invention. FIG. 7 further illustrates the significant versatility afforded by the present invention. Particularly, accessories and utilitarian articles may be secured to the inventive strap in a wide variety of ways. As examples, referring briefly to FIG. 1, FIG. 1 illustrates accessory 130 secured to strap 105 at clasp 115. Alternatively, referring briefly to FIG. 4, FIG. 4 illustrates article 405 secured to strap 105 by being captured in loop 305. FIG. 7 illustrates yet another configuration. Specifically, in the embodiment of FIG. 7, accessory 705 is secured to strap 105 by being attached to zipper pull 205 of zipper slider 120. Alternatively, accessory 705 could be secured by attaching to the body of slider 120 without pull 205. Slider 120 may be locking, which has the effect of securing accessory 705 in a specified location along zipper 117. Alternatively, slider 120 may be non-locking, allowing accessory 705 to be positioned at any time anywhere along zipper 117.

Figure 8:
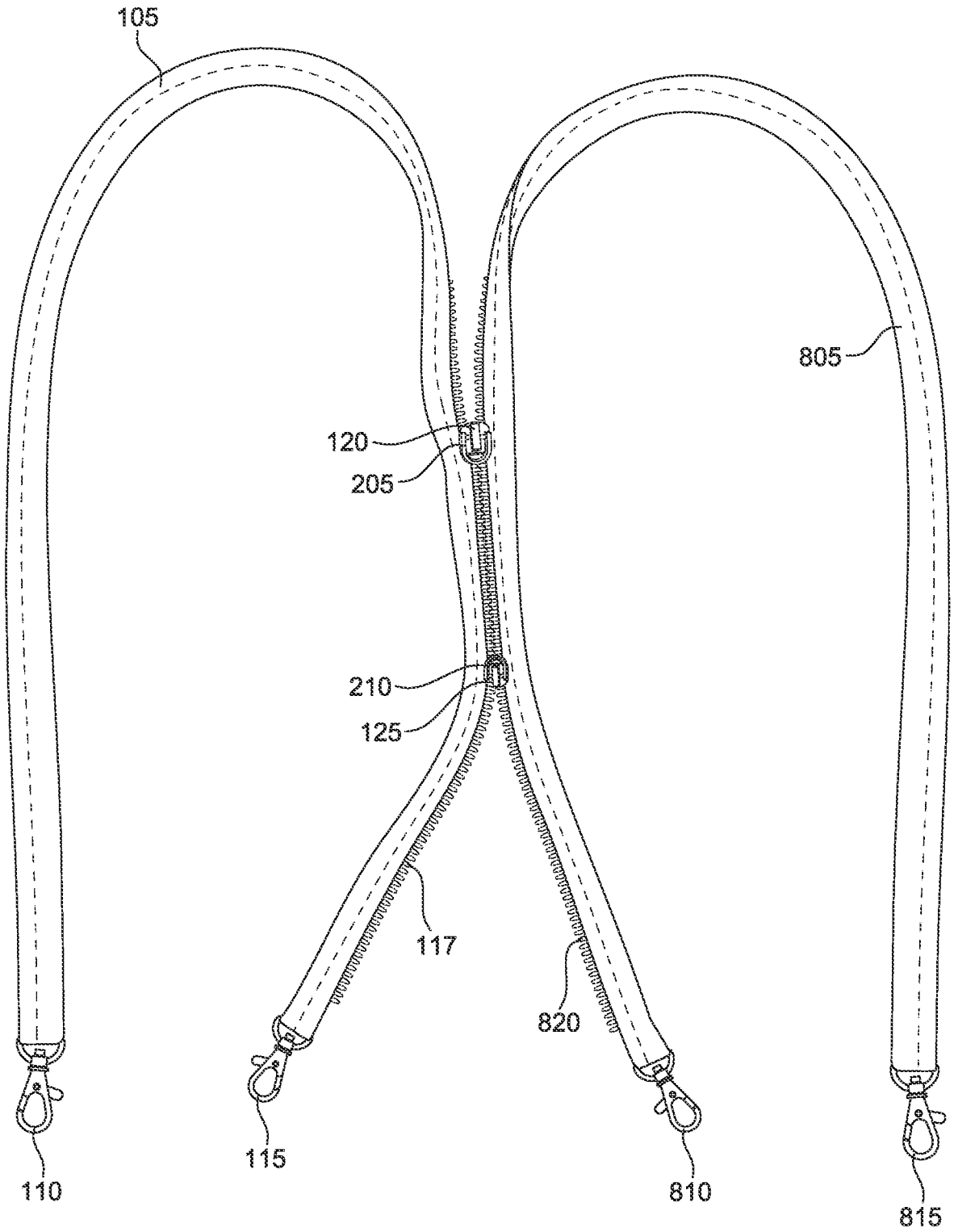
FIG. 8 illustrates two straps coupled to one another according to one embodiment of the present invention.

Turning now to FIG. 8, FIG. 8 illustrates two straps coupled to one another according to one embodiment of the present invention. In the illustrated embodiment, strap 805 comprises zipper 820. Strap 805 is coupled to strap 105 by zipper sliders 120 and 125 joining zippers 117 and 820. This double strap configuration provides a variety of advantages including enhancing visual appeal, strength, and configuration versatility. In certain embodiments, strap 805 can further include clasps 810 and 815 which may be employed in the same variety of ways as clasps 110 and 115 described above.

Consequently, a long-felt need for a strap that provides significant wearing and carrying versatility, and visual appeal, is satisfied. Specifically, a strap that can be configured to be worn in a variety of arrangements on the body while supporting fashion accessories or utilitarian articles is provided. Additionally, in certain embodiments, the strap, when reconfigured, maintains its configuration stably and reliably. Furthermore, in certain embodiments the strap can serve as an element of a fashion assembly that is visually appealing and designed to be particularly comfortable to wear on one's person. Also, in certain embodiments the strap is constructed from components traditionally available in the fashion accessory and apparel fields, such as clasps, zippers and zipper sliders.

The foregoing description of the embodiments of the invention has been presented for the purpose of illustration; it is not intended to be exhaustive or to limit the invention to the precise forms disclosed. The description and drawings are, accordingly, to be regarded in an illustrative rather than a restrictive sense. The language used in the specification has been principally selected for readability and instructional purposes. It is therefore intended that the scope of the invention be limited not by this detailed description and drawings, but rather by any claims that issue based on this application. It will, however, be evident that various modifications and changes may be made thereunto without departing from the broader spirit and scope of the invention.

What is claimed is:

1. A configurable strap comprising:

a first elongated strap;

a first zipper attached to a first edge of the first elongated strap;

a first zipper slider disposed on the first zipper, wherein the first zipper slider is lockable and when locked cannot move in at least one direction along the first zipper;

a first end clasp disposed at a first end of the first elongated strap, wherein the first end clasp is clasped to the first zipper slider forming a first strap loop; and a second end clasp disposed at a second end of the first elongated strap.

2. The configurable strap of claim 1, further comprising a second zipper slider disposed on the first zipper.

3. The configurable strap of claim 2, wherein the second zipper slider is lockable and when locked cannot move in at least one direction along the first zipper.

4. The configurable strap of claim 2, further comprising a first pouch accessory coupled to the second end clasp.

5. The configurable strap of claim 2, wherein the second end clasp is clasped to the second zipper slider forming a second strap loop.

6. The configurable strap of claim 5, further comprising a first accessory, wherein the first accessory is captured securely by the second strap loop.

7. The configurable strap of claim 1, further comprising a first teeth liner layer extending over a first side of the first zipper.

8. The configurable strap of claim 1, further comprising:

a second zipper disposed parallel to, and on a second edge of the first elongated strap opposite the first edge;

a third zipper slider disposed on the second zipper; and a fourth zipper slider disposed on the second zipper.

9. The configurable strap of claim 1, further comprising a second elongated strap, the second elongated strap comprising a second zipper coupled to the first zipper by the first zipper slider and a second zipper slider.

10. A configurable strap comprising:

a first elongated strap;

a first zipper attached to a first edge of the first elongated strap;

a first zipper slider disposed on the first zipper;

a first end clasp disposed at a first end of the first elongated strap, wherein the first end clasp is clasped to the first zipper slider forming a first strap loop; and a second zipper slider disposed on the first zipper; and a second end clasp disposed on a second end of the first elongated strap.

11. The configurable strap of claim 10, wherein the first zipper slider and the second zipper slider are each lockable and when locked cannot move in at least one direction along the first zipper.

12. The configurable strap of claim 11, further comprising a first pouch accessory coupled to the second end clasp.

13. The configurable strap of claim 10, further comprising a first teeth liner layer extending over a first side of the first zipper.

14. The strap of claim 10, further comprising:

a second zipper disposed parallel to, and on a second edge of the first elongated strap opposite the first edge;

a third zipper slider disposed on the second zipper; and a fourth zipper slider disposed on the second zipper.

15. The configurable strap of claim 10, wherein the first zipper slider is lockable and when locked cannot move in at least one direction along the first zipper, and wherein the second end clasp is clasped to the second zipper slider forming a second strap loop.

16. The configurable strap of claim 15, further comprising a first accessory, wherein the first accessory is captured securely by the second strap loop.

17. The configurable strap of claim 10, further comprising a second elongated strap, the second elongated strap comprising a second zipper couple to the first zipper by the first zipper slider and a second zipper slider.

18. A configurable strap comprising:

A first elongated strap;

a first zipper attached to a first edge of the first elongated strap;

a teeth liner layer extending over a first side of the first zipper;

a first zipper slider disposed on the first zipper, wherein the first zipper slider is lockable and when locked cannot move in at least one direction along the first zipper;

a second zipper slider disposed on the first zipper, wherein the second zipper slider is lockable and when locked cannot move in at least one direction along the first zipper;

a first end clasp disposed at a first end of the first elongated strap, wherein the first end clasp is clasped to the first zipper slider forming a first strap loop;

a second end clasp disposed at a second end of the first elongated strap; and an accessory attached to and suspended by the second end clasp.

19. The configurable strap of claim 18, further comprising:

a second zipper disposed parallel to, and on a second edge of the first elongated strap opposite the first edge;

a third zipper slider disposed on the second zipper; and a fourth zipper slider disposed on the second zipper.

20. The configurable strap of claim 18, further comprising a second elongated strap, the second elongated strap comprising a second zipper couple to the first zipper by the first zipper slider and the second zipper slider.

* * * * *